US012595790B2

(12) United States Patent
Tanaka et al.

(10) Patent No.: US 12,595,790 B2
(45) Date of Patent: Apr. 7, 2026

(54) FLUID CONTROL DEVICE

(71) Applicant: Murata Manufacturing Co., Ltd., Kyoto (JP)

(72) Inventors: Nobuhira Tanaka, Kyoto (JP); Yutoku Kawabata, Kyoto (JP); Hiroki Achiwa, Kyoto (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 143 days.

(21) Appl. No.: 18/191,119

(22) Filed: Mar. 28, 2023

(65) Prior Publication Data

US 2023/0235733 A1 Jul. 27, 2023

Related U.S. Application Data

(63) Continuation of application No. PCT/JP2021/029967, filed on Aug. 17, 2021.

(30) Foreign Application Priority Data

Sep. 30, 2020 (JP) ..... 2020-164523

(51) Int. Cl.
*F04B 45/047* (2006.01)
*F04D 33/00* (2006.01)

(52) U.S. Cl.
CPC ..... *F04B 45/047* (2013.01); *F04D 33/00* (2013.01)

(58) Field of Classification Search
USPC ..... 417/413.1–413.3
See application file for complete search history.

(56) References Cited

U.S. PATENT DOCUMENTS 4,504,156 A * 3/1985 Currie ..... H01L 23/345 374/45
5,863,185 A * 1/1999 Cochimin ..... F04D 13/10 417/43

(Continued)

FOREIGN PATENT DOCUMENTS

DE 102019215036 A1 * 4/2021
JP H05-19578 U 3/1993

(Continued)

OTHER PUBLICATIONS

Definition of pump (Obtained from https://www.merriam-webster.com/dictionary/pump on Oct. 12, 2024) (Year: 2024).*

(Continued)

*Primary Examiner* — Bryan M Lettman
*Assistant Examiner* — Geoffrey S Lee
(74) *Attorney, Agent, or Firm* — McDonald Hopkins LLC

(57) ABSTRACT

A fluid control device includes a pump and an outer housing containing the pump. The outer housing has a first outer wall that forms an internal space on a flat plate side of the pump and that has a through hole allowing the internal space and an external space to communicate with each other. The first outer wall includes an outer wall main plate facing a piezoelectric element, and a side plate that is connected to the outer wall main plate and that has the through hole. The outer wall main plate has a higher thermal conductivity than that of a second outer wall.

14 Claims, 7 Drawing Sheets

(56) References Cited

U.S. PATENT DOCUMENTS 5,906,481 A * 5/1999 Ogawa ..... B41J 2/1643 417/322
5,995,370 A * 11/1999 Nakamori ..... H05K 1/0206 361/708
6,070,851 A * 6/2000 Tsai ..... B81B 3/0035 60/528
11,300,115 B2 * 4/2022 Tanaka ..... F04B 45/045
11,746,770 B2 * 9/2023 Mou ..... F04B 45/047 417/480
2005/0258533 A1 * 11/2005 Kumano ..... H01L 25/0657 257/E23.105
2006/0281398 A1 * 12/2006 Yokomizo ..... G06F 1/203 454/184
2009/0010780 A1 * 1/2009 Kamitani ..... F04B 43/046 417/480
2009/0232683 A1 * 9/2009 Hirata ..... F04B 45/047 417/413.2
2009/0232684 A1 * 9/2009 Hirata ..... F04B 43/046 417/413.2
2010/0145272 A1 * 6/2010 Cefai ..... F04B 43/043 604/114
2013/0323085 A1 * 12/2013 Hirata ..... F04B 43/046 417/413.1
2015/0023819 A1 * 1/2015 Tanaka ..... F04D 33/00 417/410.2
2015/0237710 A1 * 8/2015 Yano ..... H05K 1/0207 174/255
2018/0066650 A1 * 3/2018 Fujisaki ..... F04B 53/16
2018/0187672 A1 * 7/2018 Tanaka ..... F04B 45/04
2018/0368704 A1 * 12/2018 Kawamura ..... F16K 7/17
2019/0060943 A1 * 2/2019 Mou ..... B05B 17/0607
2020/0040885 A1 2/2020 Funasaka et al.
2020/0198114 A1 * 6/2020 Suzuki ..... H01L 23/367
2020/0224650 A1 * 7/2020 Tanaka ..... F04B 45/045
2020/0318630 A1 * 10/2020 Kondo ..... F04B 43/046
2020/0340469 A1 * 10/2020 Tanaka ..... F04B 43/046
2022/0260068 A1 * 8/2022 Kodama ..... F04B 45/047
2023/0235733 A1 * 7/2023 Tanaka ..... F04B 43/046 417/413.2
2024/0018954 A1 * 1/2024 Kawabata ..... F04B 43/04
2024/0288394 A1 * 8/2024 Maki ..... G01N 27/227

FOREIGN PATENT DOCUMENTS

JP 2000-265964 A 9/2000
JP 2001-182661 A 7/2001
JP 2004172313 A * 6/2004
JP 2005-229038 A 8/2005
JP 2007-198147 A 8/2007
JP 2020-020283 A 2/2020
WO WO-2015013746 A1 * 2/2015 ..... H01L 41/331
WO 2017/038565 A1 3/2017

OTHER PUBLICATIONS

Definition of insulate (obtained from https://www.merriam-webster.com/dictionary/insulate on Oct. 15, 2024) (Year: 2024).*
Translation JP-2004172313 Harada (Obtained from USPTO Search) (Year: 2025).*
Translation DE 102019215036—Gaiser (Obtained from USPTO Search) (Year: 2025).*
International Search Report for PCT/JP2021/029967 dated Sep. 21, 2021.

* cited by examiner

FLUID CONTROL DEVICE

CROSS REFERENCE TO RELATED APPLICATION

This is a continuation of International Application No. PCT/JP2021/029967 filed on Aug. 17, 2021 which claims priority from Japanese Patent Application No. 2020-164523 filed on Sep. 30, 2020. The contents of these applications are incorporated herein by reference in their entireties.

BACKGROUND OF THE DISCLOSURE

Field of the Disclosure

The present disclosure relates to a fluid control device including a pump and a housing containing the pump.

Description of the Related Art

Patent Document 1 describes a piezoelectric blower including a pump unit, a valve unit, and an outer housing. The pump unit and the valve unit communicate with each other. The portion composed of the pump unit and the valve unit is disposed in the outer housing. The structure composed of the pump unit and the valve unit is fixed to the outer housing.

The structure composed of the pump unit and the valve unit divides the internal space of the outer housing into a space on the pump side and a space on the valve side. The outer housing is provided with a through hole that allows the space on the pump side to communicate with the external space, and a through hole that allows the space on the valve side to communicate with the external space.

The pump unit includes a piezoelectric element. By applying a drive voltage signal to the piezoelectric element, the piezoelectric element functions as a pump. The piezoelectric element is exposed to the space on the pump side.

Patent Document 1: International Publication No. 2017-038565

BRIEF SUMMARY OF THE DISCLOSURE

However, in the configuration described in the Patent Document 1, when the piezoelectric element is driven for a long time, the generated heat is trapped in the outer housing. As a result, the temperature of the entire piezoelectric blower rises, and the characteristics as a blower (fluid control device) deteriorate.

Therefore, a possible benefit of the present disclosure is to provide a fluid control device capable of suppressing the deterioration of the characteristics due to the heat generation of the piezoelectric element.

The present disclosure provides a fluid control device including a pump and an outer housing that contains the pump. The pump includes a first flat plate, a second flat plate that is disposed so as to face the first flat plate with a space between the first flat plate and the second flat plate, the second flat plate forming a pump chamber together with the first flat plate, and a piezoelectric element that is disposed on a surface of the first flat plate on a side opposite to the pump chamber. The outer housing has a first outer wall that forms a first internal space on a side of the first flat plate and that has a first through hole allowing the first internal space and an external space to communicate with each other, and a second outer wall that forms a second internal space on a side of the second flat plate and that has a second through hole allowing the second internal space and the external space to communicate with each other. The first outer wall has a first outer wall main plate that faces the piezoelectric element, and a first side plate that is connected to the first outer wall main plate and that has the first through hole. The first outer wall main plate has a higher thermal conductivity than that of the second outer wall.

With this configuration, the heat generated by driving of the piezoelectric element is dissipated to the external space with high efficiency through the first outer wall main plate.

According to the present disclosure, the deterioration of the characteristics due to the heat generation of the piezoelectric element can be suppressed.

DETAILED DESCRIPTION OF THE DISCLOSURE

First Embodiment

Figure 1:
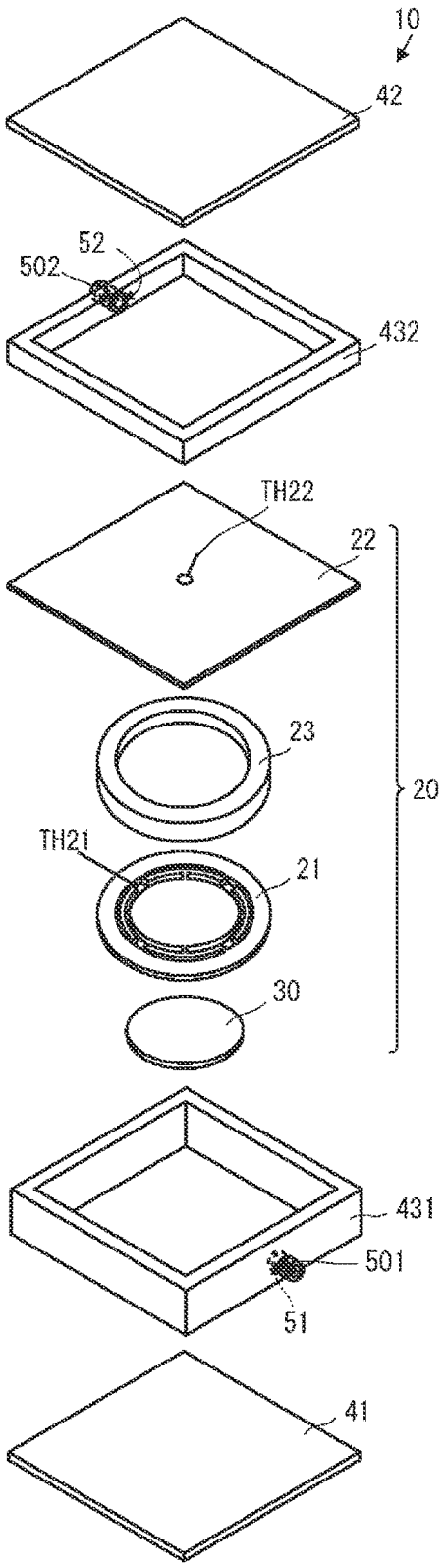
FIG. 1 is an exploded perspective view illustrating an example of a configuration of a fluid control device 10 according to a first embodiment.
Figure 2A:
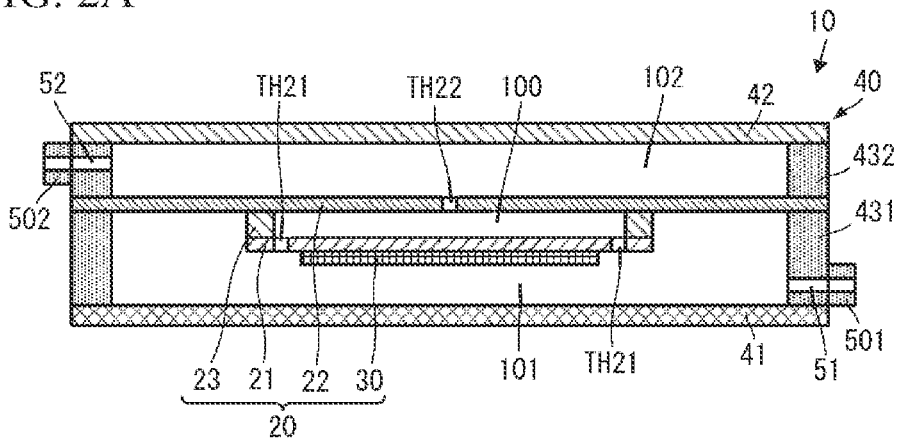
FIG. 2A is a side sectional view illustrating the example of the configuration of the fluid control device 10 according to the first embodiment.
Figure 2B:
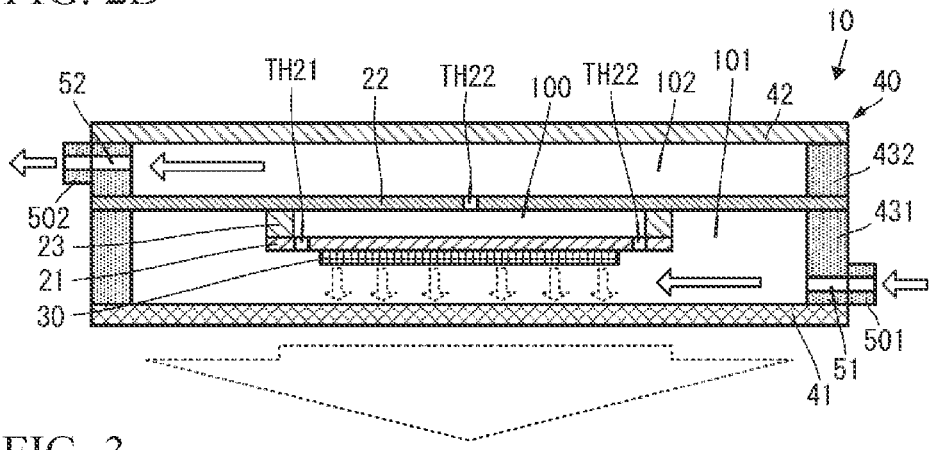
FIG. 2B is a view schematically illustrating a heat dissipation state of the fluid control device 10 according to the first embodiment.

A fluid control device according to a first embodiment of the present disclosure will be described with reference to the drawings. FIG. 1 is an exploded perspective view illustrating an example of a configuration of a fluid control device 10 according to the first embodiment. FIG. 2A is a side sectional view illustrating the example of the configuration of the fluid control device 10 according to the first embodiment, and FIG. 2B is a view schematically illustrating a heat dissipation state of the fluid control device 10 according to the first embodiment. In each figure of each embodiment including the present embodiment, the shape of each component is partially or entirely exaggerated in order to make the configuration of the fluid control device 10 easy to understand.

As illustrated in FIGS. 1 and 2A, the fluid control device 10 includes a pump 20 and an outer housing 40. Schematically, the pump 20 is contained in the outer housing 40.

(Configuration of Pump 20)

The pump 20 includes a flat plate 21, a flat plate 22, a pump frame 23, and a piezoelectric element 30.

The flat plate 21 is a circular plate. The flat plate 21 is made of a metal plate or the like. A through hole TH21 is formed in the flat plate 21. The through hole TH21 extends through the flat plate 21 in a thickness direction. The through hole TH21 is formed in the vicinity of an outer peripheral end in the flat plate 21. More specifically, in plan view, the through hole TH21 is formed on an outer peripheral side of a portion where the flat plate 21 overlaps the piezoelectric element 30 and on a central side of a portion where the flat plate 21 overlaps the pump frame 23 described later. The through hole TH21 is a groove having a discrete shape and formed along the outer periphery of the flat plate 21. As a result, bending vibration may occur in a portion of the flat plate 21 inside the portion where the through hole TH21 is formed.

The piezoelectric element 30 is disposed on one main surface of the flat plate 21. The piezoelectric element 30 is a circular plate, and the shape thereof in plan view is smaller than the flat plate 21. In plan view, the center of the piezoelectric element 30 and the center of the flat plate 21 substantially coincide with each other. The piezoelectric element 30 is achieved by, for example, a flat plate piezoelectric body and an electrode pattern formed on each main surface of the piezoelectric body.

The flat plate 22 has a predetermined shape (a rectangular shape in the fluid control device 10) in plan view, is formed of a material that is less likely to be bent than the flat plate 21, and has a thickness.

The flat plate 22 is disposed on the other main surface side (a side opposite to a side on which the piezoelectric element 30 is disposed) of the flat plate 21. The flat plate 22 is disposed away from the flat plate 21 in a direction orthogonal to a main surface (flat plate surface). The main surface of the flat plate 22 and the main surface of the flat plate 21 are parallel to each other. The area of the flat plate 22 in plan view is larger than the area of the flat plate 21 in plan view. In plan view, the center of the flat plate 22 and the center of the flat plate 21 substantially coincide with each other. A through hole TH22 is formed in the flat plate 22. The through hole TH22 extends through the flat plate 22 in a thickness direction. The through hole TH22 is disposed at the center of the flat plate 22 in plan view.

The pump frame 23 has an annular shape. The pump frame 23 is disposed between the flat plate 21 and the flat plate 22 and is joined to or adheres to the flat plate 21 and the flat plate 22. As a result, the pump 20 has a pump chamber 100 that is surrounded by the flat plate 21, the flat plate 22, and the pump frame 23. Note that the flat plate 21 corresponds to a "first flat plate" of the present disclosure, and the flat plate 22 corresponds to a "second flat plate" of the present disclosure.

(Configuration of Outer Housing 40)

The outer housing 40 includes an outer wall main plate 41, an outer wall main plate 42, a side plate 431, and a side plate 432. Note that in the configuration of FIGS. 1 and 2A, the outer peripheral end portion of the flat plate 22 also constitutes part of the outer housing 40.

(Configuration of First Outer Wall)

A first outer wall is configured with the outer wall main plate 41 and the side plate 431.

The outer wall main plate 41 is a flat plate having a predetermined shape. For example, in the case of FIGS. 1 and 2A, the outer wall main plate 41 is a flat plate having a rectangular shape in plan view. The shape of the outer wall main plate 41 in plan view is larger than the flat plate 21, is substantially as large as the flat plate 22, and is substantially the same as the shape of the flat plate 22.

The outer wall main plate 41 is disposed on the one main surface side (a side on which the piezoelectric element 30 is disposed) of the flat plate 21. A flat plate surface (main surface) of the outer wall main plate 41 and a flat plate surface (main surface) of the flat plate 21 are parallel to and face each other. The outer wall main plate 41 is disposed away from the flat plate 21 in a direction orthogonal to the flat plate surface (main surface) of the flat plate 21. The distance between the outer wall main plate 41 and the flat plate 21 is a distance at which the piezoelectric element 30 and the outer wall main plate 41 do not come into contact with each other by bending vibration of the flat plate 21 in normal use of the fluid control device 10.

The outer wall main plate 41 is made of a metal (metal plate). In this case, it is preferable to use a metal having high thermal conductivity as a material of the outer wall main plate 41. However, the material of the outer wall main plate 41 may be selected in consideration of thermal conductivity and rigidity. That is, as the material of the outer wall main plate 41, a material that can obtain desired thermal conductivity while having the rigidity required for the fluid control device 10 may be selected. For example, the outer wall main plate 41 may be steel use stainless (SUS) or the like, and the main material of the outer wall main plate 41 may be, for example, SUS. In addition, for example, Cu or the like can be used, and in this case, an insulating thin film described later is more preferably provided for the reliability and the like.

Note that a material having high thermal conductivity means that, for example, the heat transmission rate and diffusion rate of a substance made of the material are high.

The side plate 431 has a loop shape having a predetermined height. One end of the side plate 431 in a height direction is connected to an outer peripheral end portion of the flat plate 22. The other end of the side plate 431 in the height direction is connected to an outer peripheral end portion of the outer wall main plate 41. With this configuration, on the flat plate 21 side of the pump 20, an internal space 101 surrounded by the outer wall main plate 41, the side plate 431, and the flat plate 22 of the pump 20 is formed. With this configuration, the piezoelectric element 30 is disposed in the internal space 101.

A through hole 51 is formed in the side plate 431. In addition, a nozzle 501 is disposed on the outer surface side of the portion in the side plate 431 where the through hole 51 is formed. The opening of the nozzle 501 communicates with the through hole 51. Note that the nozzle 501 may be integrally formed with the side plate 431 or may be formed separately. The internal space 101 communicates with the external space through the through hole 51.

Note that the outer wall main plate 41 corresponds to a "first outer wall main plate" of the present disclosure, and the side plate 431 corresponds to a "first side plate" of the present disclosure. In addition, the internal space 101 corresponds to a "first internal space" of the present disclosure. In addition, the through hole 51 corresponds to a "first through hole" of the present disclosure.

(Configuration of Second Outer Wall)

A second outer wall is configured with the outer wall main plate 42 and the side plate 432.

The outer wall main plate 42 is a flat plate having a predetermined shape. For example, in the case of FIGS. 1 and 2A, the outer wall main plate 42 is a flat plate having a rectangular shape in plan view. The shape of the outer wall main plate 42 in plan view is substantially as large as the flat plate 22 and is substantially the same as the shape of the flat plate 22.

The outer wall main plate 42 is disposed on a side opposite to a side of the flat plate 22 facing the flat plate 21. A flat plate surface (main surface) of the outer wall main plate 42 and a flat plate surface (main surface) of the flat plate 22 are parallel to and face each other. The outer wall main plate 42 is disposed away from the flat plate 22 in a direction orthogonal to the flat plate surface (main surface) of the flat plate 22.

The outer wall main plate 42 is made of a metal (metal plate). Note that the outer wall main plate 42 does not have to be made of a metal.

The side plate 432 has a loop shape having a predetermined height. One end of the side plate 432 in a height direction is connected to the outer peripheral end portion of the flat plate 22. The other end of the side plate 432 in the height direction is connected to an outer peripheral end portion of the outer wall main plate 42. With this configuration, on the flat plate 22 side of the pump 20, an internal space 102 surrounded by the outer wall main plate 42, the side plate 432, and flat plate 22 of the pump 20 is formed.

A through hole 52 is formed in the side plate 432. In addition, a nozzle 502 is disposed on the outer surface side of the portion in the side plate 432 where the through hole 52 is formed. The opening of the nozzle 502 communicates with the through hole 52. Note that the nozzle 502 may be integrally formed with the side plate 432 or may be formed separately. The internal space 102 communicates with the external space through the through hole 52.

Note that the outer wall main plate 42 corresponds to a "second outer wall main plate" of the present disclosure, and the side plate 432 corresponds to a "second side plate" of the present disclosure. In addition, the internal space 102 corresponds to a "second internal space" of the present disclosure. In addition, the through hole 52 corresponds to a "second through hole" of the present disclosure.

(Operation of Fluid Control Device 10)

In the fluid control device 10 having the above configuration, an alternating current drive signal is applied to the electrode pattern of the piezoelectric element 30 when a fluid is transported. As a result, the piezoelectric body of the piezoelectric element 30 is distorted. As the stress due to the distortion is applied to the flat plate 21, the flat plate 21 vibrates in a bending manner. The volume and pressure in the pump chamber 100 fluctuate due to the bending vibration of the flat plate 21.

Due to the pressure fluctuation, for example, the fluid is sequentially sucked from the internal space 101 through the through hole TH21. The fluid in the internal space 101 is supplied from the external space through the through hole 51 and the nozzle 501. The fluid sucked into the pump chamber 100 is discharged to the internal space 102 through the through hole TH22, and the fluid in the internal space 102 is discharged to the external space through the through hole 52 and the nozzle 502.

Alternatively, due to the pressure fluctuation, for example, the fluid is sequentially sucked from the internal space 102 through the through hole TH22. The fluid in the internal space 102 is supplied from the external space through the through hole 52 and the nozzle 502. The fluid sucked into the pump chamber 100 is discharged to the internal space 101 through the through hole TH21, and the fluid in the internal space 101 is discharged to the external space through the through hole 51 and the nozzle 501.

For example, one of the operations of transporting the fluid in one direction described above is continuously performed. As a result, the fluid control device 10 can transport the fluid in one direction.

A drive signal is continuously applied to the piezoelectric element 30, and distortion is continuously generated. As a result, the piezoelectric element 30 generates heat.

In the fluid control device 10, the outer wall main plate 41 faces the piezoelectric element 30. Therefore, as illustrated in FIG. 2B, the heat generated from the piezoelectric element 30 is transferred to the outer wall main plate 41 through the internal space 101 and is dissipated to the external space from the outer wall main plate 41.

Here, the outer wall main plate 41 is made of a metal. That is, the outer wall main plate 41 has high thermal conductivity. As a result, the heat generated from the piezoelectric element 30 and transferred to the outer wall main plate 41 through the internal space 101 is transferred and diffused in the outer wall main plate 41 and is transferred to the surface of the outer wall main plate 41 on the external space side. Then, the heat transferred to the surface of the outer wall main plate 41 on the external space side is radiated to the external space.

As a result, the fluid control device 10 can effectively dissipate the heat of the internal space 101 and the piezoelectric element 30. As a result, the fluid control device 10 can effectively suppress the temperature rise of the internal space 101 and the piezoelectric element 30.

Figure 3:
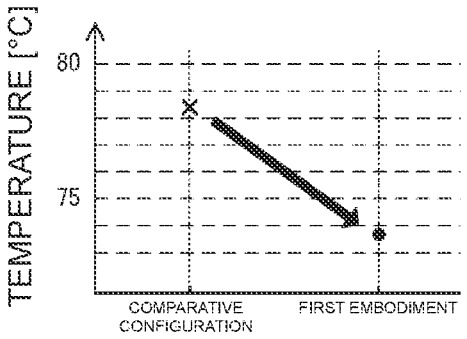
FIG. 3 is a graph illustrating a temperature of an internal space on a piezoelectric element side in a fluid control device having a comparative configuration and the fluid control device 10 having the configuration according to the first embodiment of the present disclosure.

FIG. 3 is a graph illustrating the temperature of the internal space on the piezoelectric element side in a fluid control device having a comparative configuration and the fluid control device 10 having the configuration according to the first embodiment of the present disclosure. FIG. 3 illustrates the temperature after the continuous driving of the piezoelectric element 30 for 20 minutes at 1 W in an environment of 25° C. Note that in the comparative configuration, the outer housing is formed of an insulating resin. As illustrated in FIG. 3, the temperature of the internal space can be lowered by using the configuration of the present application.

As a result, the fluid control device 10 can suppress the deterioration of the fluid transport characteristics due to an increase in temperature. Moreover, the fluid control device 10 can reduce the thermal stress on each component constituting the fluid control device 10 and can improve the reliability. For example, the fluid control device 10 can extend the product life.

Although the thickness of the outer wall main plate 41 is not described in detail in the above description, the thickness of the outer wall main plate 41 is preferably as thin as possible in consideration of the above-described rigidity. As a result, the fluid control device 10 can realize more effective heat dissipation.

Second Embodiment

Figure 4:
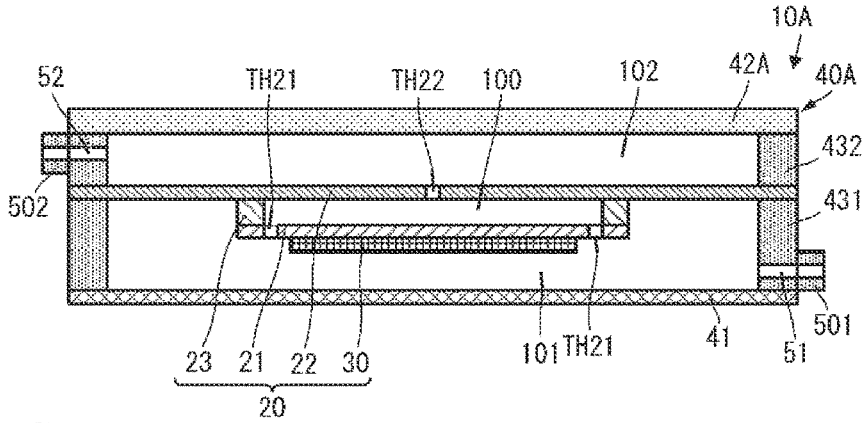
FIG. 4 is a side sectional view illustrating an example of a configuration of a fluid control device 10A according to a second embodiment.

A fluid control device according to a second embodiment of the present disclosure will be described with reference to the drawings. FIG. 4 is a side sectional view illustrating an example of a configuration of a fluid control device 10A according to the second embodiment.

As illustrated in FIG. 4, the fluid control device 10A according to the second embodiment is different from the fluid control device 10 according to the first embodiment in the configuration of an outer wall main plate 42A of an outer housing 40A. Other configurations of the fluid control device 10A are the same as those of the fluid control device 10, and the description of the same components will be omitted.

The fluid control device 10A includes the outer housing 40A, and the outer housing 40A includes the outer wall main plate 42A. The outer wall main plate 42A is formed of an insulating resin. With such a configuration, the fluid control device 10A can exhibit the same action and effect as the fluid control device 10.

Figure 5:
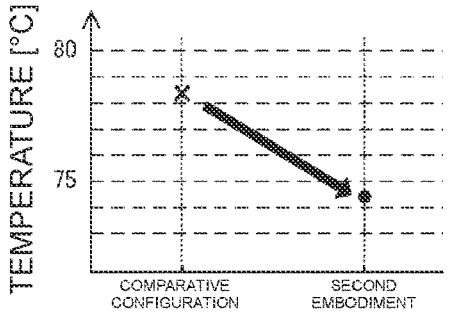
FIG. 5 is a graph illustrating a temperature of an internal space on a piezoelectric element side in a fluid control device having a comparative configuration and the fluid control device 10A having the configuration according to the second embodiment of the present disclosure.

FIG. 5 is a graph illustrating the temperature of the internal space on the piezoelectric element side in a fluid control device having a comparative configuration and the fluid control device 10A having the configuration according to the second embodiment of the present disclosure. FIG. 5 illustrates the temperature after the continuous driving of the piezoelectric element 30 for 20 minutes at 1 W in an environment of 25° C. Note that in the comparative configuration, the outer housing is formed of an insulating resin. As illustrated in FIG. 5, the temperature of the internal space can be lowered by using the configuration of the present embodiment.

Moreover, the fluid control device 10A can realize weight reduction.

In the fluid control device 10A, the outer wall main plate 42A is made thicker than the outer wall main plate 41. As a result, the fluid control device 10A can increase the rigidity of the outer housing 40A even when the outer wall main plate 42A is formed of an insulating resin.

In other words, in the fluid control device 10A, the outer wall main plate 41 is made thinner than the outer wall main plate 42A. As a result, the fluid control device 10A can realize further weight reduction while maintaining the predetermined rigidity in the outer housing 40A. In addition, by making the outer wall main plate 41 thinner, the fluid control device 10A can further improve the heat dissipation (heat exhaust property to the external space).

In this case, the fluid control device 10A can improve the heat dissipation by making at least a portion of the outer wall main plate 41 facing the piezoelectric element 30 (a portion overlapping the piezoelectric element 30 in plan view). In addition, the fluid control device 10A can improve the heat dissipation and ensure higher rigidity by making only a portion of the outer wall main plate 41 facing the piezoelectric element 30 (a portion overlapping the piezoelectric element 30 in plan view).

Note that in the above description, an aspect in which the outer wall main plate 42A and the side plate 432 are formed separately is described. However, the outer wall main plate 42A and the side plate 432 may be integrally formed.

Third Embodiment

Figure 6A:
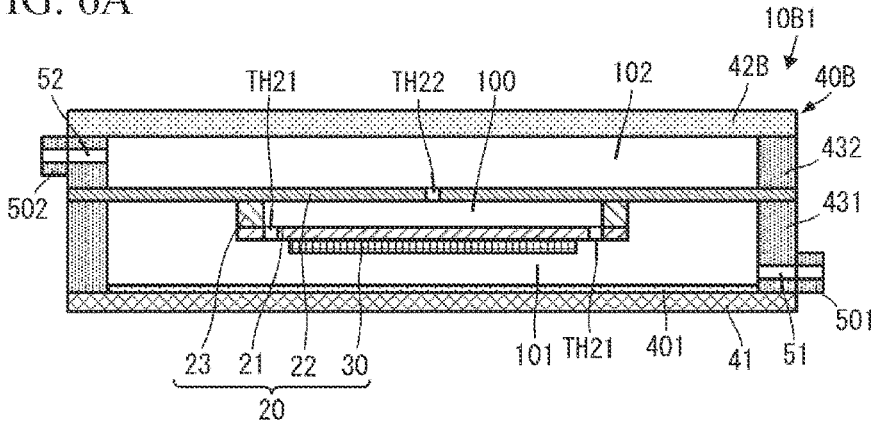
FIGS. 6A and 6B are side sectional views illustrating examples of configurations of fluid control devices 10B1 and 10B2 according to a third embodiment.
Figure 6B:
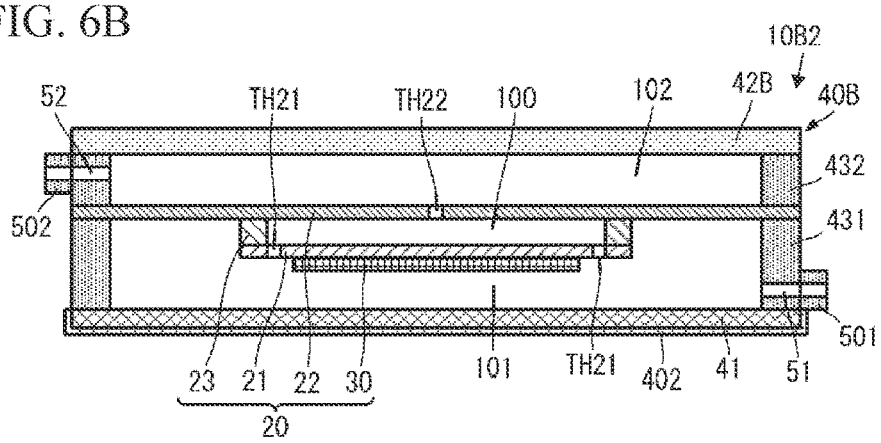

A fluid control device according to a third embodiment of the present disclosure will be described with reference to the drawings. FIG. 6A is a side sectional view illustrating an example of a configuration of a fluid control device 10B1 according to the third embodiment, and FIG. 6B is a side sectional view illustrating an example of a configuration of a fluid control device 10B2 according to the third embodiment.

As illustrated in FIG. 6A, the fluid control device 10B1 according to an aspect of the third embodiment is different from the fluid control device 10A according to the second embodiment in that an insulating thin film 401 is included. Note that in the fluid control device 10B1, an outer housing 40B and an outer wall main plate 42B are the same as the outer housing 40A and the outer wall main plate 42A of the fluid control device 10A. Other configurations of the fluid control device 10B1 are the same as those of the fluid control device 10A, and the description of the same components will be omitted.

The fluid control device 10B1 includes the insulating thin film 401. The insulating thin film 401 is disposed on the surface of the outer wall main plate 41 on the piezoelectric element 30 side. The insulating thin film 401 is thinner than the outer wall main plate 41 and has the predetermined thermal conductivity. In this case, by using the insulating thin film 401 having high thermal conductivity, the heat emission rate of the surface of the outer wall main plate 41 on the internal space 101 side can be increased, and an increase in the thermal resistance from the internal space 101 to the outer wall main plate 41 can be suppressed.

With such a configuration, the fluid control device 10B1 can exhibit the same action and effect as the fluid control device 10A and can suppress a short circuit between the outer wall main plate 41 made of a metal and the piezoelectric element 30.

Note that FIG. 6A illustrates an aspect in which the insulating thin film 401 is disposed on the entire surface of the outer wall main plate 41 on the piezoelectric element 30 side. However, the insulating thin film 401 may be disposed at least in a portion of the outer wall main plate 41 facing the piezoelectric element 30 (a portion overlapping the piezoelectric element 30 in plan view). In addition, the fluid control device 10B1 can ensure the heat dissipation and suppress a short circuit by disposing the insulating thin film 401 only in a portion of the outer wall main plate 41 facing the piezoelectric element 30 (a portion overlapping the piezoelectric element 30 in plan view).

As illustrated in FIG. 6B, the fluid control device 10B2 according to an aspect of the third embodiment is different from the fluid control device 10A according to the second embodiment in that an insulating thin film 402 is included. Note that in the fluid control device 10B2, the outer housing 40B and the outer wall main plate 42B are the same as the outer housing 40A and the outer wall main plate 42A of the fluid control device 10A. Other configurations of the fluid control device 10B2 are the same as those of the fluid control device 10A, and the description of the same components will be omitted.

The fluid control device 10B2 includes the insulating thin film 402. The insulating thin film 402 is disposed on the surface of the outer wall main plate 41 on the external space side. The insulating thin film 402 is thinner than the outer wall main plate 41 and has the predetermined thermal conductivity. In this case, by using the insulating thin film 402 having high thermal conductivity, the heat emission rate of the surface of the outer wall main plate 41 on the external space side can be increased, and an increase in radiation resistance of the heat from the outer wall main plate 41 to the external space can be suppressed.

With such a configuration, the fluid control device 10B2 can exhibit the same action and effect as the fluid control device 10A and can suppress a short circuit between the outer wall main plate 41 made of a metal and an external conductor or the like.

Note that FIG. 6B illustrates an aspect in which the insulating thin film 402 is disposed on the entire surface of the outer wall main plate 41 on external space side. However, the insulating thin film 402 may be disposed at least in a necessary portion of the outer wall main plate 41. For example, the insulating thin film 402 may be disposed only in a portion facing a conductor in proximity to the fluid control device 10B2. In addition, in FIG. 6B, the fluid control device 10B2 can ensure the heat dissipation and suppress a short circuit by disposing the insulating thin film 402 only in a necessary portion of the outer wall main plate 41.

Note that in the fluid control device, both the insulating thin film 401 illustrated in FIG. 6A and the insulating thin film 402 illustrated in FIG. 6B can be disposed. In addition, in FIGS. 6A and 6B, the insulating thin film 401 and the insulating thin film 402 may be disposed in a predetermined pattern. For example, the insulating thin film 401 may have a mesh shape, a polka dot shape, or the like.

Fourth Embodiment

Figure 7A:
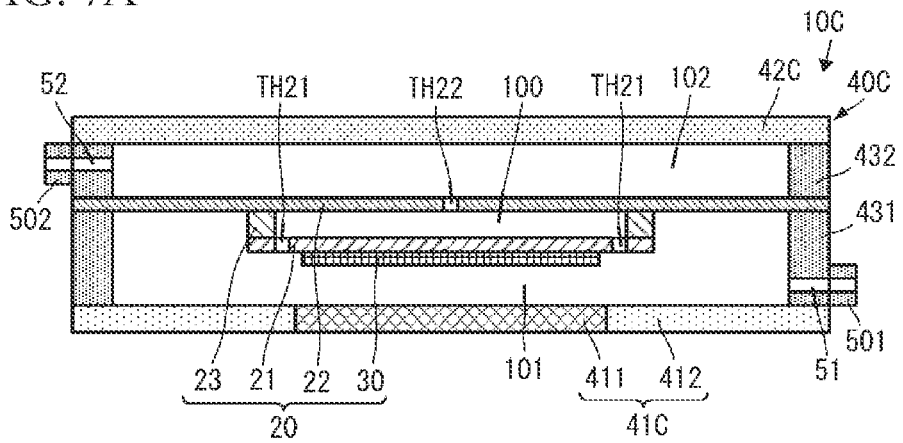
FIG. 7A is a side sectional view illustrating an example of a configuration of a fluid control device 10C according to a fourth embodiment.

A fluid control device according to a fourth embodiment of the present disclosure will be described with reference to the drawings. FIG. 7A is a side sectional view illustrating an example of a configuration of a fluid control device 10C according to the fourth embodiment, and FIG. 7B is an exploded perspective view illustrating part of the configuration of the fluid control device 10C according to the fourth embodiment.

Figure 7B:
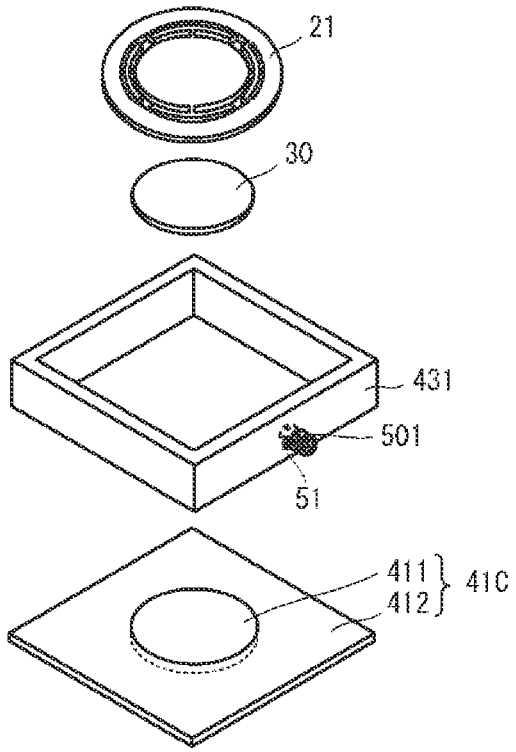
FIG. 7B is an exploded perspective view illustrating part of the configuration of the fluid control device 10C according to the fourth embodiment.

As illustrated in FIGS. 7A and 7B, the fluid control device 10C according to the fourth embodiment is different from the fluid control device 10A according to the second embodiment in the configuration of an outer wall main plate 41C of an outer housing 40C. Note that in the fluid control device 10C, an outer wall main plate 42C is the same as the outer wall main plate 42A of the fluid control device 10A. Other configurations of the fluid control device 10C are the same as those of the fluid control device 10A, and the description of the same components will be omitted.

The outer wall main plate 41C includes a metal portion 411 and a resin portion 412. The resin portion 412 is disposed so as to surround the outer periphery of the metal portion 411.

The metal portion 411 has, for example, a circular plate shape. The planar shape of the metal portion 411 is substantially the same as the planar shape of the piezoelectric element 30. The metal portion 411 faces the piezoelectric element 30. Note that the area of the metal portion 411 does not have to be substantially the same as the area of the piezoelectric element 30, and is preferably equal to or larger than the area of the piezoelectric element 30.

With such a configuration, the fluid control device 10C can effectively dissipate the heat of the internal space 101 and the piezoelectric element 30. In addition, the fluid control device 10C can realize weight reduction.

Note that it is also possible to make the metal portion 411 thinner than the resin portion 412, and with this configuration, the fluid control device 10C can more effectively dissipate heat.

Fifth Embodiment

Figure 8A:
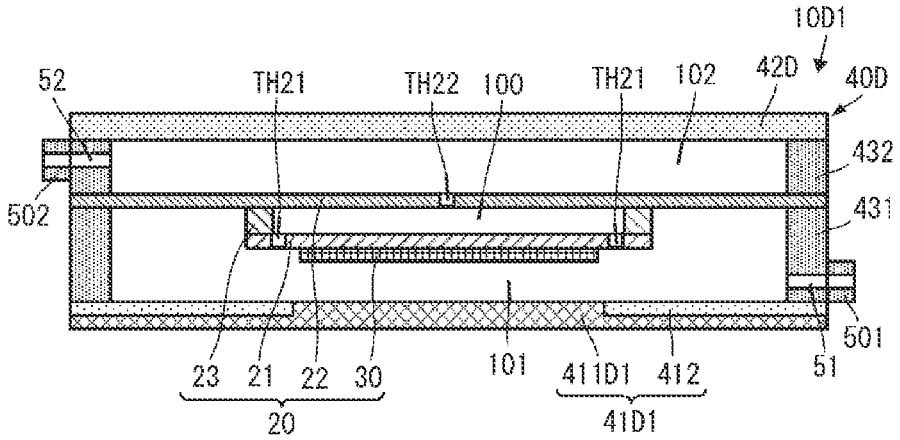
FIGS. 8A and 8B are side sectional views illustrating examples of configurations of fluid control devices 10D1 and 10D2 according to a fifth embodiment.

A fluid control device according to a fifth embodiment of the present disclosure will be described with reference to the drawings. FIG. 8A is a side sectional view illustrating an example of a configuration of a fluid control device 10D1 according to the fifth embodiment, and FIG. 8B is a side sectional view illustrating an example of a configuration of a fluid control device 10D2 according to the fifth embodiment.

Figure 8B:
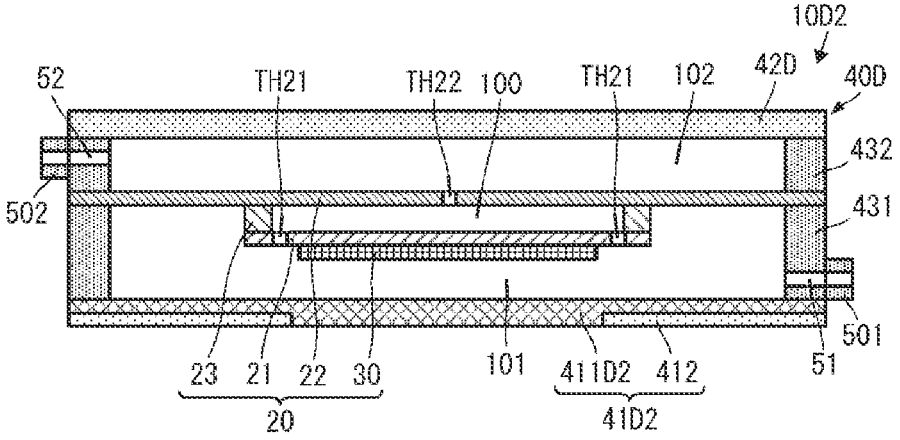

As illustrated in FIGS. 8A and 8B, the fluid control devices 10D1 and 10D2 according to the fifth embodiment are different from the fluid control device 10A of the second embodiment in outer wall main plates 41D1 and 41D2 of an outer housing 40D. Note that in the fluid control devices 10D1 and 10D2, an outer wall main plate 42D is the same as the outer wall main plate 42A of the fluid control device 10A. Other configurations of the fluid control devices 10D1 and 10D2 are the same as those of the fluid control device 10A, and the description of the same components will be omitted.

As illustrated in FIG. 8A, in the fluid control device 10D1, the outer wall main plate 41D1 includes a metal portion 411D1 and a resin portion 412.

The metal portion 411D1 has two regions having different thicknesses. More specifically, the metal portion 411D1 has a thick central region and a thin peripheral region. The planar shape of the central region is substantially the same as the planar shape of the piezoelectric element 30. The peripheral region has a shape surrounding the outer periphery of the central region, and the outer shape of the peripheral region is substantially the same as the planar shape of the flat plate 22. On one main surface of the metal portion 411D1, the central region and the peripheral region are flush with each other. The other main surface of the metal portion 411D1 has a shape in which the peripheral region is recessed from the central region.

The resin portion 412 is a flat plate having an opening at the center. The resin portion 412 is disposed in a portion of the peripheral region on the other main surface side of the metal portion 411D1. In other words, the resin portion 412 is disposed so as to fill the recess of the metal portion 411D1 on the other main surface side. As a result, both main surfaces of the outer wall main plate 41D1 are flat.

The outer wall main plate 41D1 is disposed such that the other main surface of the metal portion 411D1 faces the piezoelectric element 30.

With such a configuration, the fluid control device 10D1 can effectively dissipate the heat of the internal space 101 and the piezoelectric element 30. In addition, the outer wall main plate 41D1 can be made lighter than the outer wall main plate 41, which is entirely made of a metal.

As illustrated in FIG. 8B, in the fluid control device 10D2, the outer wall main plate 41D2 includes a metal portion 411D2 and the resin portion 412.

The metal portion 411D2 has the same shape as the metal portion 411D1. The outer wall main plate 41D2 is disposed such that the other main surface of the metal portion 411D1 is exposed to the external space.

With such a configuration, the fluid control device 10D2 can effectively dissipate the heat of the internal space 101 and the piezoelectric element 30. In addition, the outer wall main plate 41D2 can be made lighter than the outer wall main plate 41, which is entirely made of a metal.

Sixth Embodiment

Figure 9A:
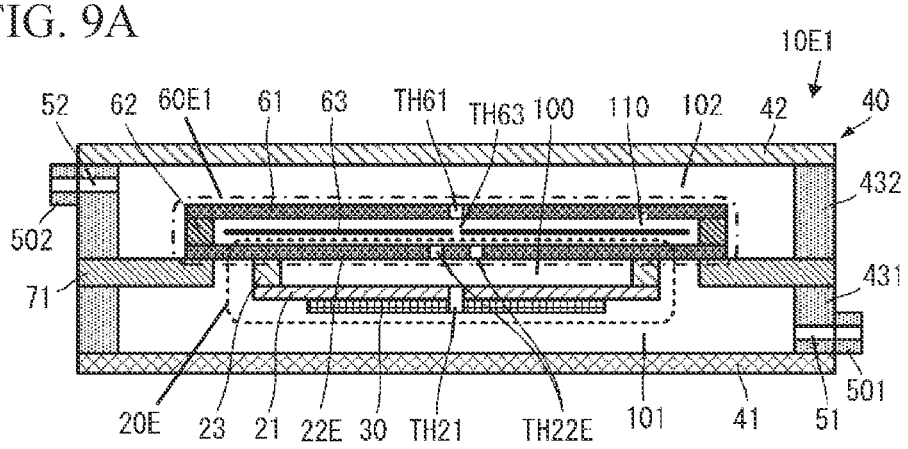
FIGS. 9A and 9B are side sectional views illustrating examples of configurations of fluid control devices 10E1 and 10E2 according to a sixth embodiment.

A fluid control device according to a sixth embodiment of the present disclosure will be described with reference to the drawings. FIG. 9A is a side sectional view illustrating an example of a configuration of a fluid control device 10E1 according to the sixth embodiment, and FIG. 9B is a side sectional view illustrating an example of a configuration of a fluid control device 10E2 according to the sixth embodiment.

Figure 9B:
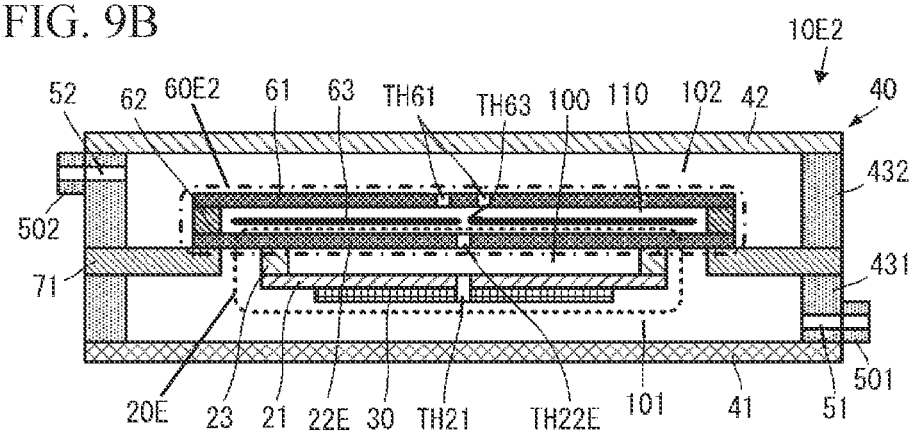

As illustrated in FIGS. 9A and 9B, the fluid control devices 10E1 and 10E2 according to the sixth embodiment are different from the fluid control device 10 according to the first embodiment in that valves 60E1 and 60E2 are included. Other configurations of the fluid control devices 10E1 and 10E2 are the same as those of the fluid control device 10, and the description of the same components will be omitted.

As illustrated in FIG. 9A, the fluid control device 10E1 includes the valve 60E1. The valve 60E1 includes a flat plate 22E, a flat plate 61, a valve frame 62, and a valve film 63.

As with the above-described flat plate 22, the flat plate 22E faces the flat plate 21 and forms the pump chamber 100 together with the flat plate 21 and the pump frame 23.

The flat plate 61 is disposed away from the flat plate 22E on a side opposite to the flat plate 21 side. The flat plate 61 faces the flat plate 22E.

The valve frame 62 has an annular shape. The valve frame 62 is disposed between the flat plate 22E and the flat plate 61 and is joined to or adheres to the flat plate 22E and the flat plate 61. As a result, the valve 60E1 has a valve chamber 110 that is surrounded by the flat plate 22E, the flat plate 61, and the valve frame 62.

The valve film 63 is disposed so as to be movable in a thickness direction in the valve chamber 110.

A through hole TH22E is formed in the flat plate 22E. A through hole TH61 is formed in the flat plate 61. In plan view (viewed in a direction orthogonal to a flat plate surface (main surface) of the flat plate 61 and the flat plate 22E), the through hole TH61 and the through hole TH22E do not overlap each other. A through hole TH63 is formed in the valve film 63, and the through hole TH63 of the valve film 63 overlaps the through hole TH61 and does not overlap the through hole TH22E.

The structure formed of the valve 60E1 and a pump 20E is fixed to the outer housing 40 by a support member 71 that separates the internal space 101 and the internal space 102.

With this configuration, the fluid control device 10E1 can transport the fluid in a direction of flowing from the pump 20E to the valve 60E1 and suppress the transportation in the reverse direction.

As illustrated in FIG. 9B, the fluid control device 10E2 includes the valve 60E2. The valve 60E2 includes the flat plate 22E, the flat plate 61, the valve frame 62, and the valve film 63. In the valve 60E2, positions at which the through hole TH22E for the flat plate 22E and the through hole TH61 for the flat plate 61 are formed are different from the valve 60E1. Other configurations of the valve 60E2 are the same as those of the valve 60E1, and the description of the same components will be omitted.

The through hole TH22E is formed in the flat plate 22E. The through hole TH61 is formed in the flat plate 61. In plan view (viewed in the direction orthogonal to the flat plate surface (main surface) of the flat plate 61 and the flat plate 22E), the through hole TH61 and the through hole TH22E do not overlap each other. The through hole TH63 is formed in the valve film 63, and the through hole TH63 of the valve film 63 overlaps the through hole TH22E and does not overlap the through hole TH61.

With this configuration, the fluid control device 10E2 can transport the fluid in a direction of flowing from the valve 60E2 to the pump 20E and suppress the transportation in the reverse direction.

With a configuration having such a valve as well, the fluid control devices 10E1 and 10E2 can effectively dissipate the heat of the internal space 101 and the piezoelectric element 30.

Seventh Embodiment

Figure 10:
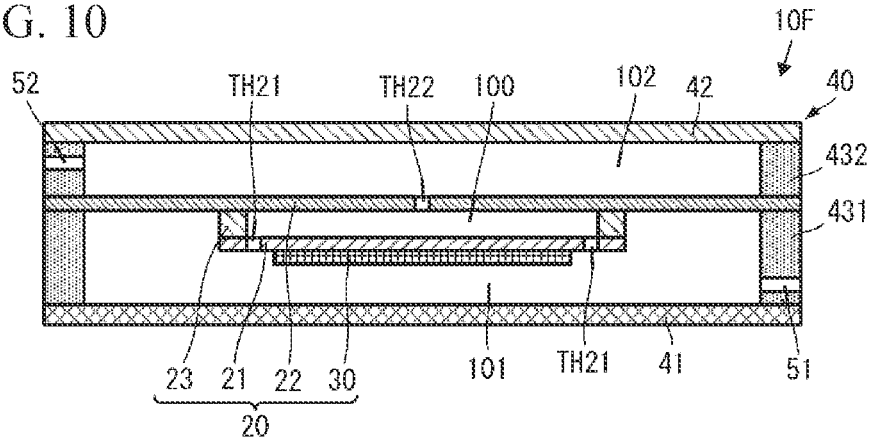
FIG. 10 is a side sectional view illustrating an example of a configuration of a fluid control device 10F according to a seventh embodiment.

A fluid control device according to a seventh embodiment of the present disclosure will be described with reference to the drawing. FIG. 10 is a side sectional view illustrating an example of a configuration of a fluid control device 10F according to the seventh embodiment.

As illustrated in FIG. 10, the fluid control device 10F according to the seventh embodiment is different from the fluid control device 10 according to the first embodiment in that the nozzles 501 and 502 are omitted. Other configurations of the fluid control device 10F are the same as those of the fluid control device 10, and the description of the same components will be omitted.

The fluid control device 10F does not have the nozzle 501 or 502. With such a configuration as well, the fluid control device 10F can effectively dissipate the heat of the internal space 101 and the piezoelectric element 30.

Eighth Embodiment

Figure 11:
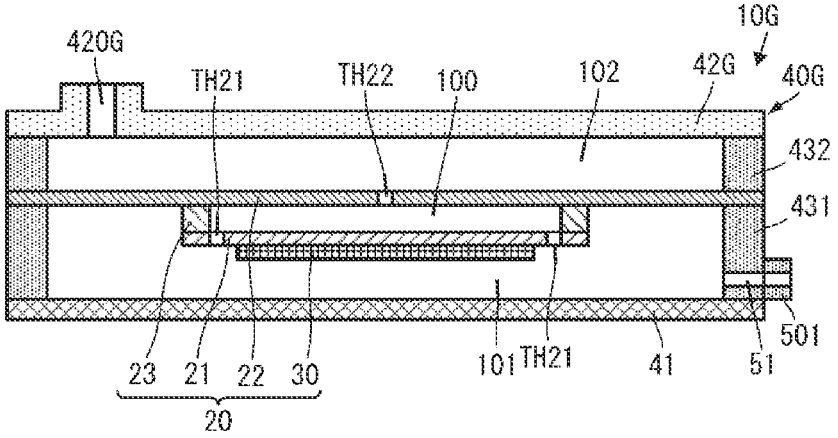
FIG. 11 is a side sectional view illustrating an example of a configuration of a fluid control device 10G according to an eighth embodiment.

A fluid control device according to an eighth embodiment of the present disclosure will be described with reference to the drawing. FIG. 11 is a side sectional view illustrating an example of a configuration of a fluid control device 10G according to the eighth embodiment.

As illustrated in FIG. 11, the fluid control device 10G according to the eighth embodiment is different from the fluid control device 10A according to the second embodiment in that a through hole 420G that allows the internal space 102 to communicate with the external space is formed. Other configurations of the fluid control device 10G are the same as those of the fluid control device 10A, and the description of the same components will be omitted.

The fluid control device 10G includes an outer housing 40G including an outer wall main plate 42G. The through hole 420G is formed in the outer wall main plate 42G.

With such a configuration as well, the fluid control device 10G can effectively dissipate the heat of the internal space 101 and the piezoelectric element 30.

Although, in each of the above-described embodiments, an aspect in which a portion made of a metal is made of one sheet of the metal is described, but a plurality of sheets of the metal may be laminated. Alternatively, the portion made of the metal may be formed by laminating the metal on a thin insulating core material such that the laminated metal becomes thicker than the core material.

The configuration of each of the above-described embodiments can be appropriately combined, and the action and effect corresponding to each combination can be exhibited.

TH21, TH22, TH22E, TH61, TH63 THROUGH HOLE
10, 10A, 10B1, 10B2, 10C, 10D1, 10D2, 10E1, 10E2, 10F, 10G FLUID CONTROL DEVICE
20, 20E PUMP
21, 22, 22E FLAT PLATE
23 PUMP FRAME
30 PIEZOELECTRIC ELEMENT
40, 40A, 40B, 40C, 40D, 40G OUTER HOUSING
41, 41C, 41D1, 41D2, 42, 42A, 42B, 42C, 42D, 42G OUTER WALL MAIN PLATE
51, 52 THROUGH HOLE
60E1, 60E2 VALVE

61 FLAT PLATE
62 VALVE FRAME
63 VALVE FILM
71 SUPPORT MEMBER
100 PUMP CHAMBER
101, 102 INTERNAL SPACE
110 VALVE CHAMBER
401, 402 INSULATING THIN FILM
411, 411D1, 411D2 METAL PORTION
412 RESIN PORTION
420G THROUGH HOLE
431, 432 SIDE PLATE
501, 502 NOZZLE

The invention claimed is:

1. A fluid control device comprising:

a pump; and an outer housing containing the pump, wherein the pump includes a first flat plate, a second flat plate, and a piezoelectric element, the second flat plate being disposed so as to face the first flat plate with a space between the first flat plate and the second flat plate, the second flat plate forming a pump chamber together with the first flat plate, and the piezoelectric element being disposed on a surface of the first flat plate on a side opposite to the pump chamber, the outer housing has a first outer wall and a second outer wall, the first outer wall forming a first internal space on a side of the first flat plate and having a first through hole allowing the first internal space and an external space to communicate with each other, and the second outer wall forming a second internal space on a side of the second flat plate and having a second through hole allowing the second internal space and the external space to communicate with each other, the first outer wall has a first outer wall main plate and a first side plate, the first outer wall main plate facing the piezoelectric element, and the first side plate being connected to the first outer wall main plate and having the first through hole, and the first outer wall main plate is higher in thermal conductivity than the second outer wall, wherein the first outer wall main plate includes a metal portion and a resin portion, wherein the metal portion is larger than the piezoelectric element and overlaps the piezoelectric element in plan view, wherein a portion of the first outer wall main plate not overlapping the piezoelectric element in plan view comprises the resin portion, wherein the second internal space is formed between the second flat plate and the second outer wall, and wherein a flat plate through hole is formed in the second flat plate.

2. The fluid control device according to claim 1, wherein the first outer wall main plate has a surface comprising a metal and facing the piezoelectric element.

3. The fluid control device according to claim 2, wherein the second outer wall comprises a resin.

4. The fluid control device according to claim 2, wherein a surface of the first outer wall main plate has an electrically insulating thin film.

5. The fluid control device according to claim 1, wherein the second outer wall comprises a resin.

6. The fluid control device according to claim 5, wherein the second outer wall has a second outer wall main plate and a second side plate, the second outer wall main plate facing the second flat plate, and the second side plate being connected to the second outer wall main plate and having the second through hole, and a portion of the first outer wall main plate facing the piezoelectric element is thinner than a portion of the second outer wall main plate overlapping the piezoelectric element in plan view.

7. The fluid control device according to claim 6, wherein a surface of the first outer wall main plate has an electrically insulating thin film.

8. The fluid control device according to claim 5, wherein a surface of the first outer wall main plate has an electrically insulating thin film.

9. The fluid control device according to claim 1, wherein a surface of the first outer wall main plate has an electrically insulating thin film.

10. The fluid control device according to claim 9, wherein the electrically insulating thin film is disposed on the surface of the first outer wall main plate on a side of the pump chamber.

11. The fluid control device according to claim 10, wherein the electrically insulating thin film is disposed in a portion of the first outer wall main plate facing the piezoelectric element.

12. The fluid control device according to claim 11, wherein the electrically insulating thin film is disposed on an entire surface of the first outer wall main plate on the side of the pump chamber.

13. The fluid control device according to claim 10, wherein the electrically insulating thin film is disposed on the surface of the first outer wall main plate on a side of the external space.

14. The fluid control device according to claim 9, wherein the electrically insulating thin film is disposed on the surface of the first outer wall main plate on a side of the external space.

* * * * *